United States Patent [19]

Childs

[11] Patent Number: 4,481,090

[45] Date of Patent: Nov. 6, 1984

[54] DECONTAMINATING METAL SURFACES

[75] Inventor: Everett L. Childs, Boulder, Colo.

[73] Assignee: The United States of America as represented by the United States Department of Energy, Washington, D.C.

[21] Appl. No.: 573,252

[22] Filed: Jan. 23, 1984

[51] Int. Cl.[3] ..... C25F 3/02; C25F 3/06; C25F 3/10

[52] U.S. Cl. ..... 204/129.75; 204/129.95; 204/140

[58] Field of Search ..... 204/129.43, 129.95, 204/144.5, 140, 129.75, 129.85

[56] References Cited

U.S. PATENT DOCUMENTS

| | | | |
|---|---|---|---|
| 1,273,432 | 7/1918 | Weeks | 204/129.75 |
| 1,314,839 | 9/1919 | Weeks | 204/129.75 |
| 1,314,842 | 9/1919 | Weeks | 204/129.75 |
| 2,468,006 | 4/1949 | Webster | 204/144.5 |
| 3,063,917 | 11/1962 | Barto, Jr. | 204/144.5 |
| 3,106,499 | 10/1963 | Kendall | 156/21 |
| 3,228,816 | 1/1966 | Kendall | 156/21 |
| 3,905,885 | 9/1975 | Bengel | 204/129.43 |
| 4,193,853 | 3/1980 | Childs | 204/129.95 |

*Primary Examiner*—Thomas Tufariello

*Attorney, Agent, or Firm*—Armand McMillan; Albert Sopp; Michael F. Esposito

[57] ABSTRACT

Radioactively contaminated surfaces can be electrolytically decontaminated with greatly increased efficiencies by using electrolytes containing higher than heretofore conventional amounts of nitrate, e.g., >600 g/l of $NaNO_3$, or by using nitrate-containing electrolytes which are acidic, e.g., of a pH<6.

21 Claims, 6 Drawing Figures

$NaNo_3$, 200 g/l
0.6 A/cm$^2$

METAL REMOVAL EFFICIENCY, %
Cr, g/l
pH 5.0
pH 5.5
pH 6.0
pH 6.5
pH 7.0
pH 7.5
20°C
NaNo3, 200 g/l
0.6 A/cm2
0
4
8
12
16
20
24
28
32
36
40

METAL REMOVAL EFFICIENCY, %
48
44
40
36
32
28
24
20
16
12
8
pH 5.0
pH 5.5
pH 6.0
pH 6.5
pH 7.0
pH 7.5
20 °C
NaNo3, 200 g/l
0.6 A/cm2
4
8
12
16
20
24
28
Cr, g/l

NaNo3, 600 g/l
pH 8.0
0.3 A/cm2
METAL REMOVAL EFFICIENCY, %
96
92
88
84
80
76
72
68
64
60
20
30
40
50
60
70
80
90
72
64
56
48
40
32
2
24
16
8
1
2
Cr, 20 g/l

DECONTAMINATING METAL SURFACES

The U.S. Government has rights in this invention pursuant to contract DE-AC04-76 DP03533 between the U.S. Dept. of Energy and Rockwell International.

CROSS REFERENCE TO RELATED APPLICATIONS

This application is related to U.S. application Ser. No. 39,428, filed on May 15, 1979, now U.S. Pat. No. 4,193,853.

BACKGROUND OF THE INVENTION

This invention relates to an improved method of decontaminating surfaces contaminated with radioactive substances using electrolytic techniques.

The state of the art of electrolytically decontaminating radioactively contaminated surfaces is represented by U.S. Pat. No. 4,193,853. Therein is disclosed the electrolytic decontamination of such surfaces using a basic aqueous solution comprising nitrate, fluoride, borate and oxalate ions. The range of nitrate content is an amount equivalent to 50–500 g/l of sodium nitrate. The borate ion is included as tetraborate or pyroborate ion for two reasons. One is to provide the necessary basic pH, and the other is to function as a poison for unwanted neutron chain reactions or criticality excursions due to the presence in the solution of fissible materials such a thorium, uranium or plutonium. Oxalate is included primarily because of its ability to significantly increase the filterability of the precipitate which results upon electrolysis. It is this precipitate which contains the removed contaminants. Fluoride ion was included in this prior art electrolyte because it was believed that it improved decontamination efficiency.

However, it has now been found that this prior art electrolyte and the corresponding decontamination electrolysis method are significantly less efficient than desired. Although there are many disclosures relating to other electrolytes containing similar ingredients, none of these have been used in environments with the significantly different and stringent demands attendant to the decontamination of radioactive surfaces. Hence, U.S. Pat. No. 4,193,853 remains as the closest state of the art. Other disclosures of related electrolytes include those of U.S. Pat. No. 1,314,842 which employs nitrates of various metals in an acidic electrolitic etching solution which can also comprise oxalate and other anions such as barium; U.S. Pat. No. 1,314,839 relating to an acidic electrolytic etching solution containing borate anions of various metals and also, optionally, other salts including nitrates, oxalates, etc; U.S. Pat. No. 1,273,432 disclosing an acidic electrolytic etching solution which can also contain oxalate, tartrate, and other ions; and U.S. Pat. Nos. 3,106,199 and 3,228,816 disclose acidic electrolytes for cleaning and polishing aluminum and comprising nitric acid and ions such as fluoride, borate, etc. However, none of these relate to the decontamination of radioactive materials and use low concentrations of nitrate anions.

SUMMARY OF THE INVENTION

Hence, it is an object of this invention to provide an improved process and a corresponding electrolyte for increasing the efficiency of an electrolytic method for decontaminating surfaces contaminated with radioactive substances such as the actinides, e.g., plutonium, uranium, americium, etc.

It is another object of this invention to provide such a process and an electrolyte which are highly compatible with standard nitrate-based chemical processes used in the nuclear industry.

Upon further study of the specification and appended claims, further objects and advantages of this invention will become apparent to those skilled in the art.

These objects have been attained by providing a process for decontaminating an object having a surface contaminated with a radioactive substance comprising, contacting said surface with a basic aqueous solution comprising nitrate anions in an amount equivalent to or greater than 600 g/l of sodium nitrate, borate anions and oxalate anions; thereafter, electrolytically removing the top layer(s) of said surface and forming a precipitate containing said radioactive substance; and subsequently separating said precipitate from the solution.

These objects have also been attained by providing, in a process for decontaminating an object having a surface contaminated with a radioactive substance and comprising contacting said surface with a basic aqueous solution comprising nitrate anions in an amount equivalent to or greater than 50–500 g/l of sodium nitrate, borate anions and oxalate anions; thereafter electrolytically removing the top layer of said surface and forming a precipitate containing said radioactive substance; and subsequently separating said precipitate from the solution, the improvement comprising adding lead or barium cations to the solution whereby any chromium ions in solution are precipitated as lead chromate or barium chromate, respectively.

They have also been attained by providing a process for decontaminating an object having a surface contaminated with a radioactive substance comprising, contacting said surface with an aqueous solution of a pH of less than 6 and comprising nitrate and borate anions; thereafter electrolytically removing the top layer of said surface and forming a precipitate containing said radioactive substance; and subsequently separating said precipitate from the solution.

These objects have still further been attained by providing the corresponding aqueous solutions as electrolytes.

BRIEF DESCRIPTION OF THE DRAWINGS

Various other objects, features and attendant advantages of the present invention will be more fully appreciated as the same becomes better understood when considered in conjunction with the accompanying drawings.

DETAILED DISCUSSION

Figure 1:
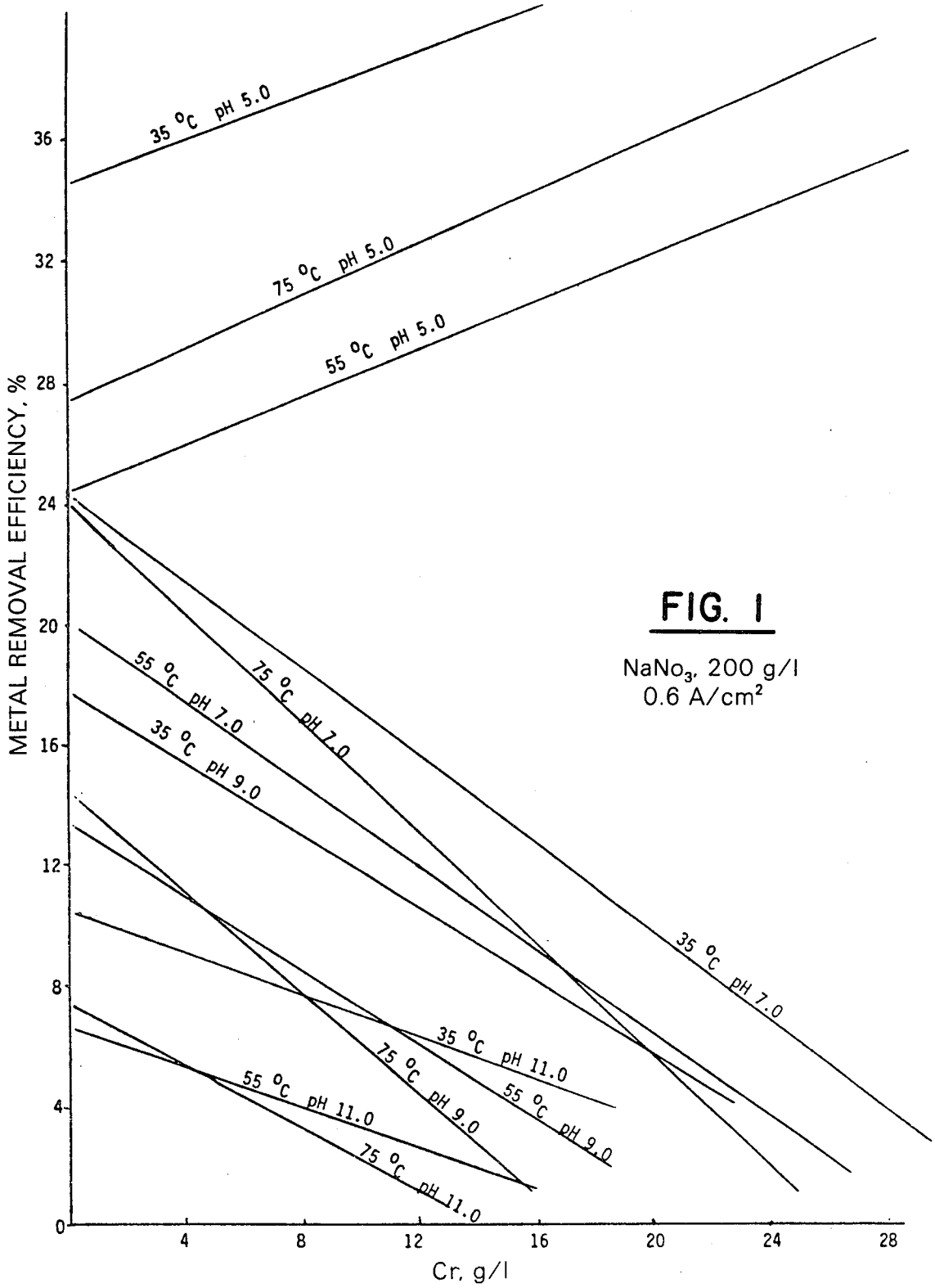
FIGS. 1–6 show various parametric dependencies of the relative decontamination efficiency under the conditions discussed in Examples 1–6, respectively.

The entire disclosure of U.S. Pat. No. 4,193,853 is incorporated by reference herein, and Childs, et al., "Electrolytic Decontamination of Stainless Steel Using a Basic Electrolyte", Nuclear Technology, volume 54, August 1981, 208–214, is also entirely incorporated by reference herein. The details of the electrolytic decontamination described in these two publications are fully applicable here except, of course, where indicated otherwise below or where incompatible with the improved invention of this application.

In one aspect, this invention involves the discovery that the efficiency of the prior art decontamination process can be dramatically improved by employing a nitrate concentration in the basic aqueous electrolyte of U.S. Pat. No. 4,193,853, which is equivalent to an amount of sodium nitrate equal to or greater than 600 g/l, preferably 600–1000 g/l. In general, it is preferred to use as high an amount of nitrate as possible without causing disadvantageous problems in other aspects, e.g., problems with effective precipitation, filterability, etc. The preferred nitrate salt is sodium nitrate but other system-compatible cations can also be used, e.g., potassium nitrate, lithium nitrate, etc. Ammonium nitrate could also be used but its volatility makes it significantly less preferred. In this aspect of the invention, the basic pH range, the use of an oxalate and the use of a borate are essentially the same as described in U.S. Pat. No. 4,193,853. The key difference is that the higher amounts of nitrate be employed, all other aspects being essentially the same. To the extent that any parameters will be different from those of U.S. Pat. No. 4,193,853, these can be routinely determined by fully conventional, routine parametric optimization experiments. As mentioned with respect to the nitrate salts, cations other than sodium can be used to provide the oxalate and borate (e.g., tetraborate or pyroborate) ions. These include other alkali metals or other cations which are soluble in the electrolyte and are system compatible.

One additional advantage of the use of the higher nitrate concentration resides in a lowering of other requirements for the overall process. For example, a significantly lower current density can be employed to achieve effective decontamination. Thus, instead of the 1–8 amperes per square inch range generally applicable in U.S. Pat. No. 4,193,853, much lower current densities, e.g., 0.5 amperes per square inch, can be successfully employed throughout the basic pH range.

It has also been discovered that the effects of temperature are significantly less significant at higher nitrate concentrations. The general trend is that decontamination efficiency increases at lower temperatures. However, the higher the nitrate concentration, the higher the efficiency at a given temperature. Using this information and that of the examples below, routine experiments can be conducted to determine optimized nitrate concentrations which will permit the desired decontamination efficiency at a desired temperature, which in most cases, of course, will be room temperature, e.g., 20°–25° C. The variation of efficiency with temperature is relatively much less severe at higher nitrate concentrations than it is at the previously employed lower nitrate concentrations, which is another significant advantage of this invention.

In U.S. Pat. No. 4,193,853, it is disclosed that fluoride ions should be added to improve decontamination efficiency. However, it has now been discovered that fluoride ion does not significantly contribute to increased efficiency. Hence, the process of this invention and the corresponding electrolyte solutions can be essentially devoid of fluoride ions.

Another significant improvement in the state of the art of decontamination of radioactively contaminated surfaces involves the discovery of the significant decrease in efficiency caused by increasing amounts of chromium ions in the basic electrolyte. In addition, the presence of chromium has been shown to decrease throwing power of the process, i.e., the ability of an electrolyte to remove metal uniformly. Hence, when the surface metallic alloy contains chromium, e.g., stainless steel (typically Type 304L), the decontamination by surface removal will unavoidably cause chromium ions, e.g., $CrO_4^{-2}$ ions to become solublized. Fortunately, using the relatively higher nitrate anion concentrations of this invention reduces the deleterious effect of chromium. For example, at a pH of 11–12, 2 g/l of chromium can be significantly disadvantageous when the heretofore conventional amounts of nitrate ions are employed. However, at 600 g/l of nitrate, the tolerable amount of chromium will be significantly increased, e.g., to the level of about 30 g/l of chromium ions at a pH of about 8. In addition, as pH is lowered, e.g., down to the lowest value of U.S. Pat. No. 4,193,853 of 7, the amount of chromium which can be tolerated before unacceptable results appear, again increases, e.g., to the level of about 40 g/l. This reflects to a certain extent the additional aspect of this invention (acidic electrolyte) discussed in detail below.

In view of this newly discovered disadvantageous effect of chromium ions, in a preferred embodiment, where amounts of chromium greater than the routinely determinable tolerable upper limit are involved, these can very easily be removed, e.g., by adding cations which precipitate the chromium, e.g., as a chromate, e.g., barium or lead. These are preferably added as barium nitrate and lead nitrate in view of optimized system compatibility. The chromate precipitate can conventionally be removed from the solution along with the otherwise conventional removal of the contaminant-containing precipitate, which is believed to be a complex iron-hydroxide-contaminant-cation-containing coprecipitate.

In using barium, lead or other cations to precipitate the chromium, there can be some interaction with the oxalates otherwise present in the solution. Precipitation of the barium or lead cations by the oxalate can occur. Where this does occur, it will be desirable to periodically or continuously meter in additional lead and/or barium to keep the chromium level at the desirable low concentration. Of course, it may also be necessary or desirable to periodically or continuously meter in sufficient oxalate to maintain the improved filterability of the contaminant-containing precipitate.

In another embodiment of this invention, the oxalate anion can be omitted if Ba and/or Pb is used to precipitate chromium anions. The resultant chromate precipitate acts to densify the decontaminant-containing precipitate and thus alleviate the need for oxalate. Generally, Ba and Pb are added to the electrolyte in a concentration just sufficient to precipitate all of the chromium. A slight excess can also be used e.g., about 1 g/l in excess. However, it is preferred to operate with slightly less than the stoichiometric quantity.

In another aspect, this invention relates to process for decontaminating a radioactively contaminated surface using an acidic electrolyte. Heretofore, it was considered that only an electrolyte of basic pH could be used. However, it has now been discovered not only that this is not the case, but that using an acidic electrolyte dramatically increases the attainable decontamination efficiency. This aspect of the invention requires that the electrolyte have a pH less than about 6,e.g., 1–6, preferably 4–6. The pH is preferably attained by the addition of a mineral acid, preferably $HNO_3$, but also $H_3PO_4$,$H_2SO_4$, etc. HF and HCl are not preferred since these can cause corrosion problems among other things. The successful use of $HNO_3$ is surprising since metals such as stainless steel are resistant to $HNO_3$ under normal circumstances. It was hence unexpected that by making the contaminated stainless steel surfaces anodic, a high efficiency electrolytic decontamination process would result.

Although the structure of the contaminant-containing precipitate which results when using the acidic electrolyte of this invention has not been determined, it is theorized to be essentially the same as the iron hydroxide-contaminant-containing-coprecipitate which occurs in the basic electrolysis. Nevertheless, whatever the precise structure of the contaminant-containing precipitate, the latter can be handled and removed in essentially the same fashion as heretofore conventional. In the acidic electrolysis of this invention, the nitrate ion is also required. It can be present in a concentration range throughout that of the prior art and also throughout that of the above-described invention. Hence, suitable ion concentrations are in the range of 50–500 g/l and continuing on up to greater than 600 g/l, e.g., up to the saturation level of nitrate ion, preferably 600–1000 g/l. As described above, increased levels of nitrate ion concentration improve system efficiency and provide the other advantageous results described above.

Another advantage of the use of the acidic electrolyte of this invention is that oxalate is not required since the precipitate has satisfactory filterability without it. In addition, the use of the acidic pH range of this invention dispenses with the need to remove chromium ions from solution at certain intolerable levels. In the acidic pH range, chromium concentration does not have a significant impact on system efficiency. In fact, increased chromium levels even increase system efficiency. However, the borate ions discussed above and in U.S. Pat. No. 4,193,853 are still recommended for use in the acidic electrolyte in view of their high cross-section in poisoning unwanted neutron chain reactions or criticality excursions.

The use of the lower pH's, per se increases efficiency much as the increased nitrate ion concentration increases efficiency. For example, lower current densities can be employed at lower pH's than at the heretofore conventional higher pH's. See the foregoing discussion. Similarly, the effect of temperature on the efficiency of the acidic electrolytes is that higher efficiencies are achieved at lower temperatures. However, as the pH is lowered, the effect of temperature will be less significant. At acidic pH's, the effect of increased nitrate ion concentrations in softening the effect of temperature is also observed. Hence, in the acidic pH range, there is even more latitude in routinely determining electrolysis conditions which will achieve a desired high efficiency at a desirable temperature, which usually will be room temperature.

In another aspect of this invention, the above-described measures of removing chromium ion concentrations can be applied to the process per se of U.S. Pat. No. 4,193,853 to achieve an unexpectedly superior decontamination efficiency.

In all of the various aspects of this invention, the details of the actual operation of the process, the apparatus employable, the types of surfaces and the types of contaminants to which the process is applicable, etc., are fully conventional and are disclosed in U.S. Pat. No. 4,193,853, Childs, et al., supra, and many other publications, and are well known to those skilled in the art.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLES

All of the following examples were conducted using the apparatus, conditions and test procedures described with reference to FIG. 1 of Childs supra unless indicated otherwise below. The sample was stainless steel, 1.5 in square.

Example 1

The functional dependence of the relative decontamination efficiency (proportional to mg of metal removed per $cm^2$ per min) was determined. At a current density of 0.6 $A/cm^2$ and a $NaNO_3$ concentration of 200 g/l. FIG. 1 shows that efficiency increases dramatically as pH decreases and also decreases as temperature increases. However, the temperature effect is highly more tolerable at low pH's. Similarly, the deleterious effects of Cr are greatly more tolerable at low pH's.

Example 2

Figure 2:
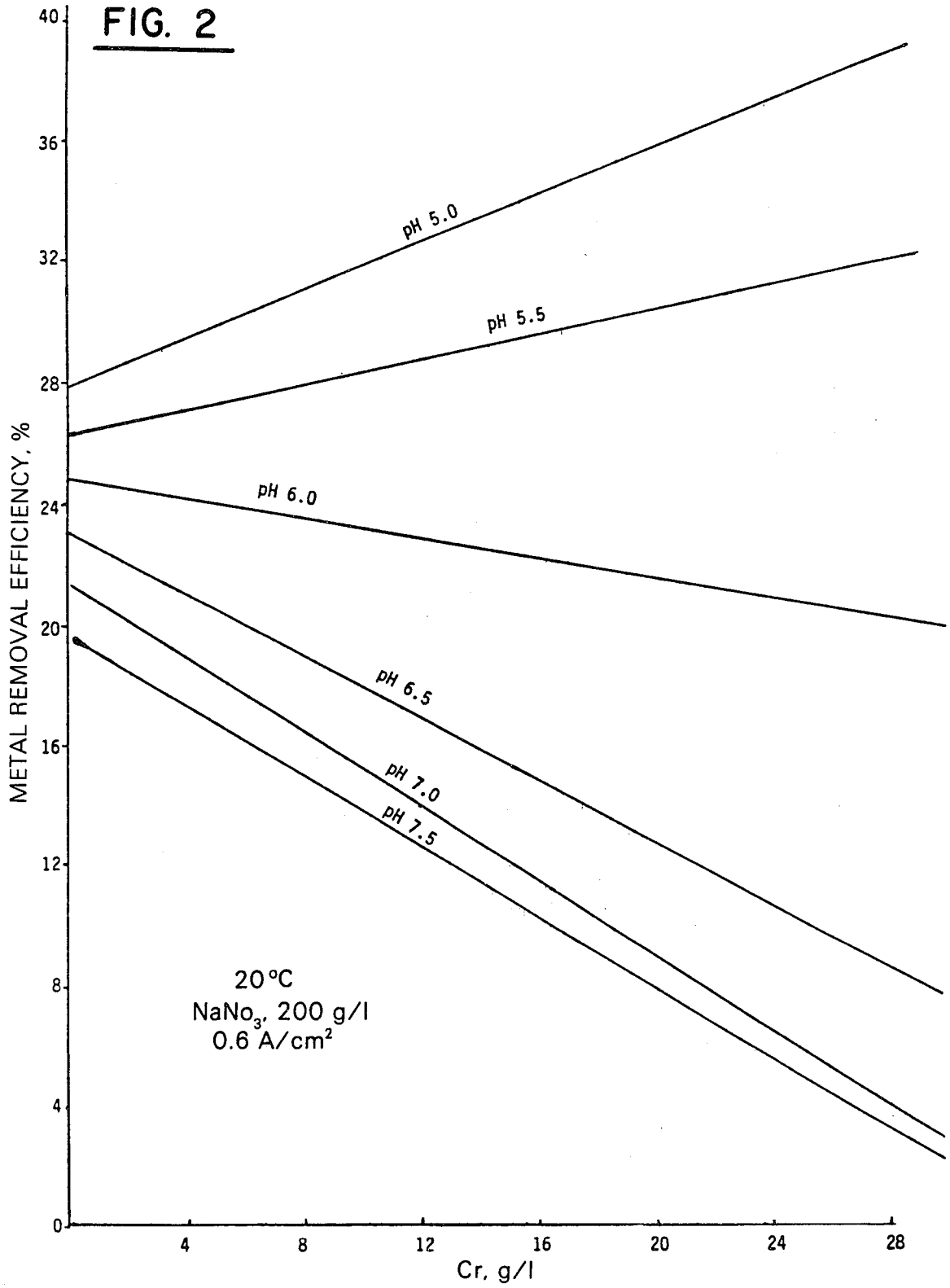

The functional dependence of the relative decontamination efficiency was determined at a current density of 0.6 $A/cm^2$, a temperature of 35° C. and a $NaNO_3$ concentration of 200 g/l. FIG. 2 shows again that the efficiency is dramatically increased at lower pH's and the effect of chromium is rendered highly tolerable at the lower pH's of this invention.

Example 3

Figure 3:
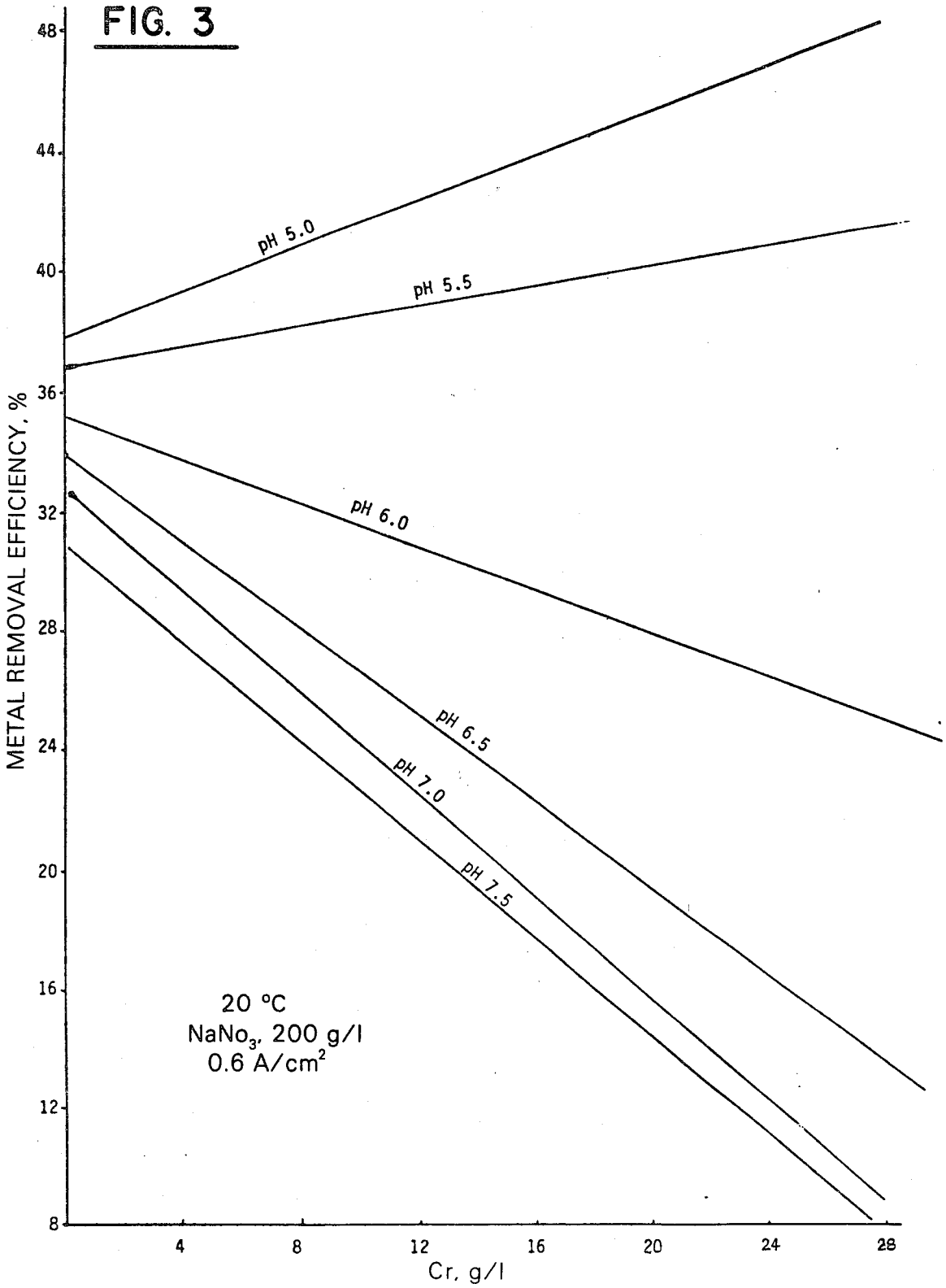

The conditions are the same as those of Example 2 except that the temperature was 20° C. The results were essentially the same, i.e., lower pH's significantly increase relative decontamination efficiency and soften the effects of chromium ions. See FIG. 3.

Example 4

Figure 4:
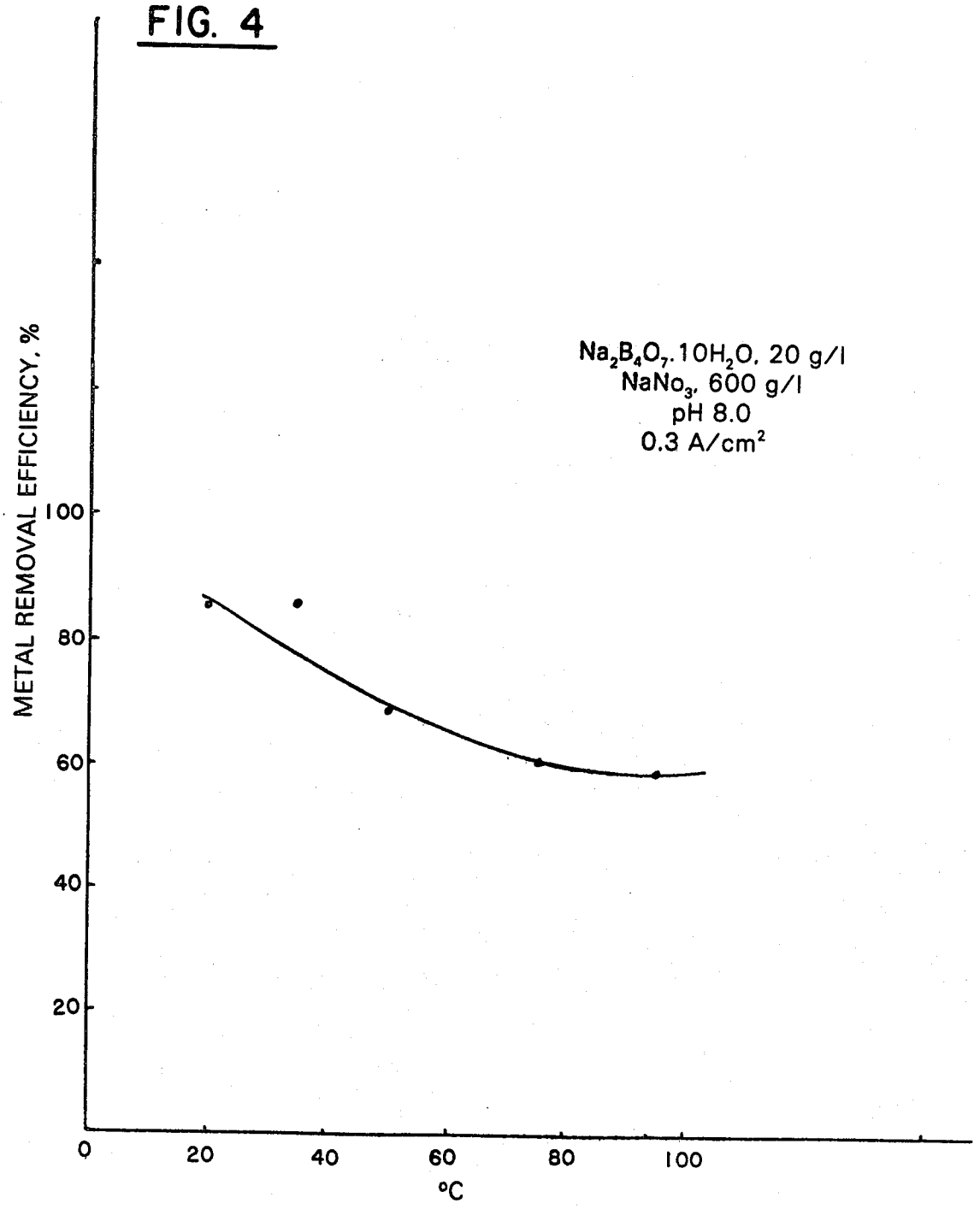

The functional dependence of the relative decontamination efficiency was determined with a current density of 0.3 $A/cm^2$, a pH of 8.0 and an electrolyte containing 600 g/l of $NaNO_3$, 20 g/l of $Na_2B_4O_7.10H_2O$ and no chromium. Measurements were made as a function of temperature and the results are shown in FIG. 4. As can be seen, the results are relatively insensitive to temperature at the high nitrate concentrations of this invention.

Example 5

Figure 5:
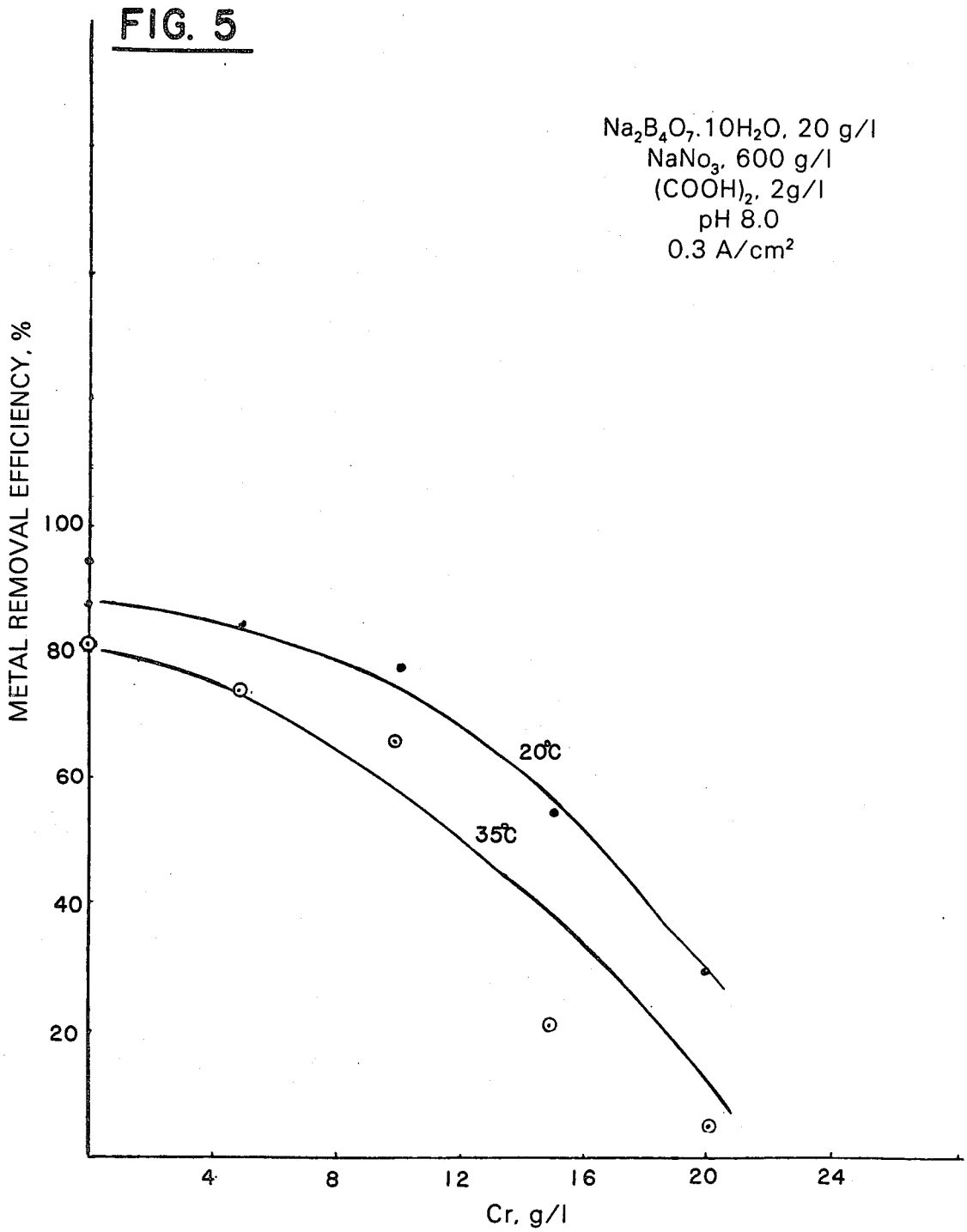

The procedure of Example 4 was repeated except that 2 g/l of $H_2C_2O_4$ was added to the electrolyte and measurements were taken as a function of chromium concentration in the electrolyte. The results are shown in FIG. 5. As can be seen, efficiency is decreased as chromium ion concentration is increased but the results are much less severe than for heretofore conventional lower concentrations of nitrate ions.

Example 6

Figure 6:
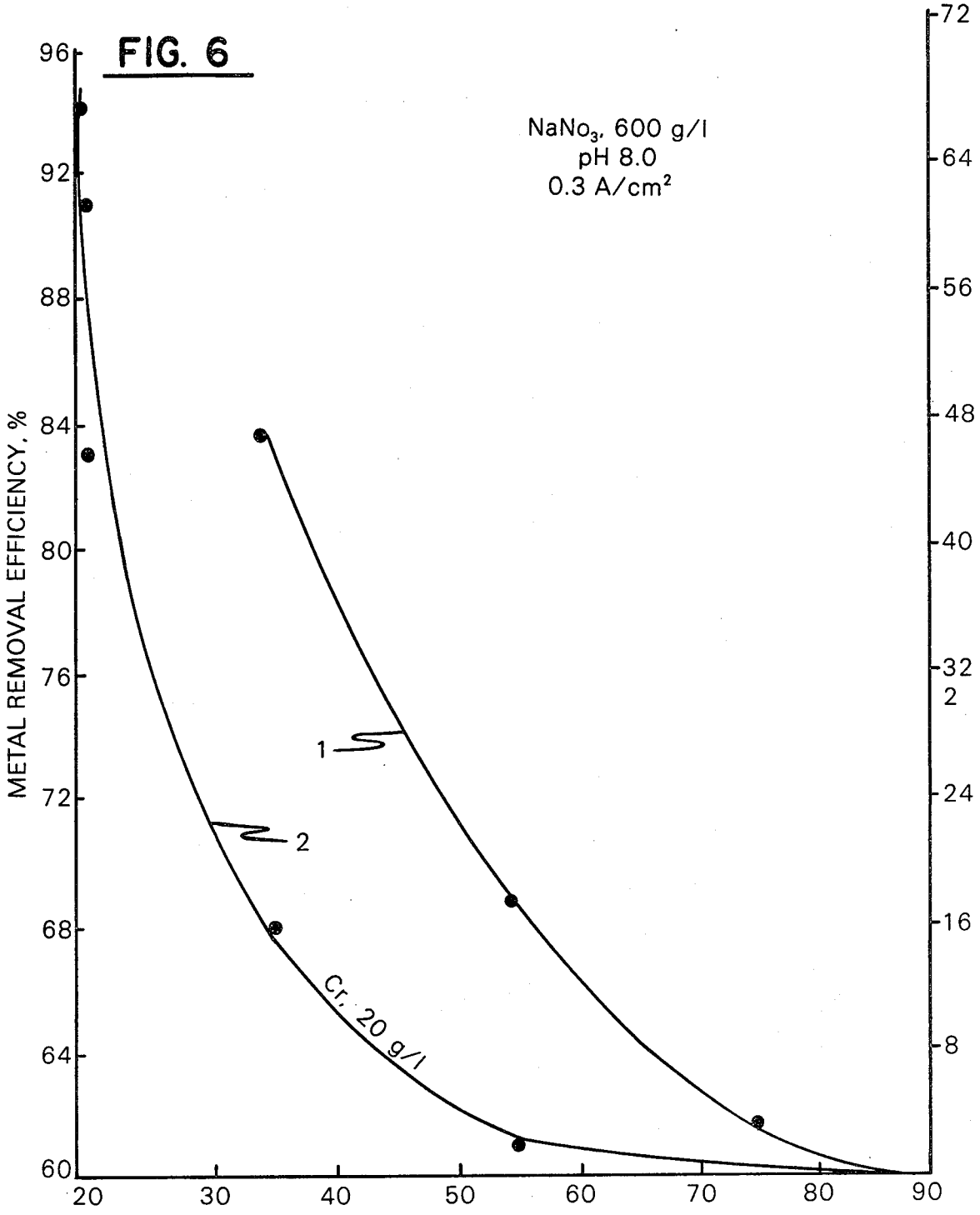

Curve 1 of FIG. 6 was generated using a concentration of sodium nitrate of 600 g/l, a current density of 0.3 $A/cm^2$, a pH of 8.0 and no chromium ions. Curve 2 was generated using the same conditions except that 20 g/l of chromium ions was included. As FIG. 6 shows, the presence of chromium ions very significantly decreased the relative decontamination efficiency at the basic pH.

Example 7

The conditions summarized in the Table below were employed except that the decontamination electrolyte also contained 5 g/l of $Ba(NO_3)_2$ and 20 g/l of $Na_2B_4O_7.10H_2O$. As can be seen, the solution efficiency is increased when chromium ions are removed by precipitation with barium cations. In addition, the use of barium at the basic pH's permits the formation of a dense precipitate even without the use of oxalate.

| Current Density ($A/cm^2$) | Temperature (°C.) | Dissolution Efficiency (%) | pH | $NaNO_3$ (g/l) |
|---|---|---|---|---|
| 0.6 | 22.8 | 31.5 | 7.5 | 200 |
| 0.6 | 34.2 | 12.7 | 7.5 | 200 |
| 0.6 | 21.7 | 88.5 | 7.5 | 600 |
| 0.6 | 34.1 | 87.0 | 7.5 | 600 |
| 0.3 | 35.1 | 72.9 | 7.5 | 600 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for decontaminating an object having a surface contaminated with a radioactive substance, comprising contacting said surface with a basic aqueous solution comprising borate anions, oxalate anions and nitrate anions in an amount equivalent to or greater than 600 g/l of sodium nitrate; thereafter electrolytically removing the top layer of said surface and forming a precipitate containing said radioactive substance; and subsequently separating said precipitate from the solution.

2. A process of claim 1 wherein the amount of nitrate anions is equivalent to 600–1000 g/l of sodium nitrate.

3. A process of claim 1 wherein the nitrate anions are present in the form of sodium nitrate.

4. A process of claim 1 wherein the basic aqueous solution comprises 600–1000 g/l of sodium nitrate, 1–20 g/l of $Na_2B_4O_7.10H_2O$, and 0.1–4 g/l of $Na_2C_2O_4$; the pH of the solution being 7–11.

5. A process of claim 1 wherein the contaminated surface comprises an alloy of at least one of iron, chromium, nickel, aluminum, copper, or lead and the radioactive substance is an actinide.

6. A process of claim 5 wherein the surface comprises iron and chromium.

7. A process of claim 6 further comprising removing chromium cations from the solution by adding lead or barium cations thereto to precipitate lead chromate or barium chromate, respectively.

8. A process of claim 7 wherein oxalate is omitted from the electrolyte.

9. A process of claim 6 wherein the chromium concentration is maintained at a level less than 10 g/l.

10. A process of claim 7 wherein the surface is a stainless steel surface and the actinide is plutonium or americium.

11. A basic aqueous solution useful in the process of claim 1 comprising 600–1000 g/l of $NaNO_3$, 1–2 g/l of $Na_2B_4O_7.10H_2O$ and 0.1–4 g/l of $Na_2C_2O_4$.

12. A process for decontaminating an object having a surface contaminated with a radioactive substance, comprising contacting said surface with an aqueous solution of a pH of less than 6 and containing nitrate and borate anions; thereafter electrolytically removing the top layer of said surface and forming a precipitate containing said radioactive substance; and subsequently separating said precipitate from the solution.

13. A process of claim 12 wherein the concentration of nitrate is an amount equivalent to 50–600 g/l of $NaNO_3$.

14. A process of claim 12 wherein the concentration of nitrate is an amount equivalent to or greater than 600 g/l of $NaNO_3$.

15. A process of claim 14 wherein the amount of nitrate is equivalent to 600–1000 g/l of sodium nitrate.

16. A process of claim 14 wherein the nitrate is present in the form of sodium nitrate.

17. A process of claim 14 wherein the solution comprises 600–1000 g/l of $NaNO_3$, 1–20 g/l of $Na_2B_4O_7.10H_2O$ and the pH is 4–6 and is achieved by addition of a corresponding amount of $HNO_3$.

18. A process of claim 14 wherein the process temperature is about 25° C.

19. A process of claim 14 wherein the contaminated surface comprises an alloy of at least one of iron, chromium, nickel, aluminum, copper, or lead and the radioactive substance is an actinide.

20. A process of claim 14 wherein the surface is a stainless steel surface and the actinide is plutonium or americium.

21. An acidic aqueous solution useful in the process of claim 12 comprising 50–1000 g/l of $NaNO_3$, 1–20 g/l of $Na_2B_4O_7.10H_2O$ and having a pH of 4–6 achieved by addition of a corresponding amount of $HNO_3$.

* * * * *